US005298672A

United States Patent [19]

Gallitzendörfer

[11] Patent Number: 5,298,672

[45] Date of Patent: Mar. 29, 1994

[54] ELECTRONIC MUSICAL INSTRUMENT WITH MEMORY READ SEQUENCE CONTROL

[76] Inventor: Rainer Gallitzendörfer, Iltisstrasse 49, D-8000 München 82, Fed. Rep. of Germany

[21] Appl. No.: 12,978

[22] Filed: Feb. 2, 1993

Related U.S. Application Data

[63] Continuation of Ser. No. 14,568, Feb. 13, 1987, abandoned.

[30] Foreign Application Priority Data

Feb. 14, 1986 [DE] Fed. Rep. of Germany ..... 3604686

[51] Int. Cl.[5] ..... G10H 1/06; G10H 7/02; G10H 7/12

[52] U.S. Cl. ..... 84/603; 84/604; 84/607; 84/622; 364/723

[58] Field of Search ..... 84/603-607, 84/622-625; 364/723

[56] References Cited

U.S. PATENT DOCUMENTS

| | | | |
|---|---|---|---|
| 3,859,884 | 1/1975 | Grable | 84/1.26 X |
| 4,164,020 | 8/1979 | Griffith | 364/718 |
| 4,185,531 | 1/1980 | Oberheim et al. | 84/1.11 |
| 4,348,929 | 9/1982 | Gallitzendorfer | 84/1.01 |
| 4,406,203 | 9/1983 | Okamoto et al. | 84/1.28 X |
| 4,413,543 | 11/1983 | Iba | 84/1.28 X |
| 4,444,082 | 4/1984 | Whitefield | 84/1.22 X |
| 4,614,983 | 9/1986 | Usami | 360/72.2 X |
| 4,667,556 | 6/1987 | Hanzawa et al. | 84/1.28 X |
| 4,681,008 | 7/1987 | Morikawa et al. | 84/1.28 |

FOREIGN PATENT DOCUMENTS

| | | | |
|---|---|---|---|
| 0150736 | 8/1985 | European Pat. Off. . | |
| 2926548 | 1/1981 | Fed. Rep. of Germany . | |
| 3402673 | 8/1984 | Fed. Rep. of Germany . | |
| 3427866 | 2/1985 | Fed. Rep. of Germany . | |
| 3519631 | 1/1986 | Fed. Rep. of Germany . | |
| 3528719 | 2/1986 | Fed. Rep. of Germany . | |
| 0141018 | 12/1978 | Japan | 84/1.01 |

*Primary Examiner*—Stanley J. Witkowski
*Attorney, Agent, or Firm*—Helfgott & Karas

[57] ABSTRACT

An electronic musical instrument utilizes a memory unit containing sampled values of waveforms stored in separately addressable memory locations. A first waveform address bus and a second waveform data bus are both connected to the unit. A counter is connected at its output to the first bus and is connected at its input to both a third address bus and a fourth system data bus. Sampled values of waveforms are supplied to the third and fourth buses. Waveform data is read out of the second bus. An arrangement including a central processing unit, a random access memory and a read only memory is connected to the third and fourth buses. This arrangement together with the counter determines, according to the stored sampled values, the sequence in which the individual memory locations and the sound information stored in the locations should be read.

13 Claims, 5 Drawing Sheets

ELECTRONIC MUSICAL INSTRUMENT WITH MEMORY READ SEQUENCE CONTROL

This is a continuation of application Ser. No. 014,568, filed Feb. 13, 1987 and now abandoned.

BACKGROUND OF THE INVENTION

In one known type of electronic musical instrument, disclosed in German Patent Specification 29 26 548, a waveform generator, allowing a stored tone to dynamically change over into another stored tone, is described to create the sound in an electronic musical instrument. Further electronic instruments are described in the prior art referred to in German Patent Specification 29 26 548, namely, German "Auslegeschrift" 22 37 594, German "Offenlegungsschrift" 28 30 483, German "Offenlegungsschrift" 28 30 482 and U.S. Pat. No. 3,859,884.

U.S. Pat. No. 4,164,020 describes a programmable sound synthesizer, holding a multiplicity of sound data in a memory. The memory is read through an address generator, whose repeat frequency is controlled by an integrator. The rate of integration is in turn determined by a "tone number." Various sound parameters, such as frequency, waveform, envelope, force of stroke, fading, etc., can be entered. These sound parameters are, however, unchangeable constituents of the stored sound data. Thus the sound data are read cyclically in the numerical sequence of the addresses of the sound data entered. Thus, briefly, only pre-programmed tone sequences can be entered with freely programmable sound characteristics, which, however, can no longer be changed during reproduction; so that, strictly speaking, these are not musical instruments, but, like a gramophone record, only "canned sounds."

The objective of the invention is to improve the aforementioned type of electronic musical instrument so that it is fully and freely programmable, producing any sound, which is also changeable at the time the instrument is played.

SUMMARY OF THE INVENTION

In accordance with the principles of the invention, certain basic sound data are stored, while the memory addresses are assigned to freely selectable sound parameters. Sound parameters, such as keystroke force, the time during which a key is depressed, the position of an adjusting device, etc., determine also the memory address to be read and the sequence of the memory addressed to be read. A tremendous multiplicity of tones can thus be produced, from all possible natural instruments and including "synthetic" tones.

The basic sound data can be entered "synthetically," i.e., through a keyboard with the help of a monitor, which allows any artificial tones to be generated; they can, however, be also entered through a microphone, so that the musical instrument of the invention constitutes a bridge between pure synthesizing and pure sampling devices. It is also possible to create a musical instrument with various voices.

More particularly, an instrument in accordance with the principles of the invention employs a memory unit containing sampled values of waveforms and/or spectral variations which are stored in a plurality of individually addressable memory locations.

A first bi-directional wave form address bus and a second bi-directional wave form data bus are both connected to the unit.

A counter is connected at its output to the first bus and is connected at its input to both a third bi-directional address bus and a fourth bi-directional system data bus.

The instrument also employs first means connected to said second bus to read out wave form data therefrom; second means connected to said third and fourth buses to supply sampled values of waveforms and/or spectral variations thereto; and third means including a central processing unit, a random access memory and a read only memory, said third means being connected to said third and fourth buses, said third means and said counter determining, according to the stored sampled values, the sequence in which the individual memory locations and the sound information stored in the locations should be read.

The aforementioned objects and advantages of the invention as well as other objects and advantages thereof will either be explained or will become apparent to those skilled in the art when this specification is read in conjunction with the accompanying drawings and specific description of preferred embodiments which follow:

DETAILED DESCRIPTION OF PREFERRED EMBODIMENTS

Certain terms used in this description will first be explained before the drawings will be described in detail.

"Sound" is to be understood as the variation of sound wave amplitudes in time (also spectral variation, if any).

"Basic Waveform" is to be understood as a variation in time of an electrical signal, corresponding to a sound, understood only as recorded (for example, via microphone) or synthetically obtained (via keyboard and monitor) variations of the amplitude of a tone.

"Waveform" refers to a set of the basic waveforms and of the sound variations interpolated or extrapolated from at least two basic waveforms of sound amplitudes.

"Basic Sound Data" refers to digitized basic waveforms (for example, 256 eight-bit words for a basic waveform). Thus, several sampling values are taken and digitized from a single basic waveform.

"Sound Data" refers to a digitized waveform.

"Sound Parameters" refers to influences of factors that may change a tone, such as:

(a) "Time": The "time parameter determines in what chronological sequence the different sound data are read;

(b) "Keystroke force": most tones of natural instruments change not only the amplitude of sound waves, but also their variation in time (for example by changing the harmonics composition, the amplitude share of non-harmonic waves, or by resonance phenomena, etc.) with their intensity.

(c) "Pitch": The "pitch" parameter changes not only the variation of frequency of a tone in the sense of a pure frequency shift, but also the tone as such, since different harmonics, resonance, etc. appear in most natural instruments according to the pitch.

Figure 1:
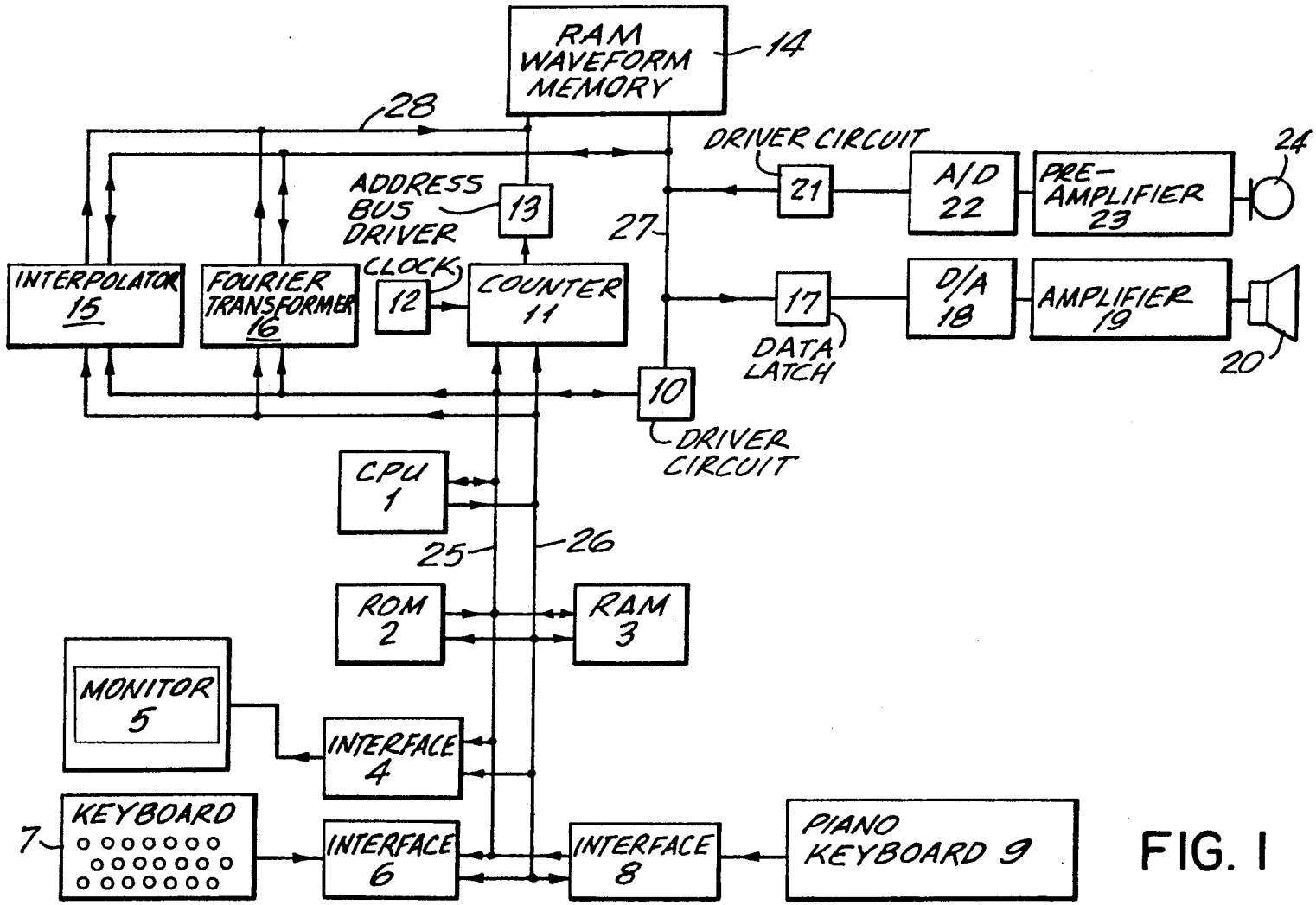
FIG. 1 is a block diagram of a first embodiment of the invention.

Now referring to FIG. 1, the musical instrument has a central unit (CPU) 1, a read-only memory (ROM) 2, a random access memory (RAM) 3, these three units being largely responsible for the control of the instrument's operation. These components are connected to each other and with other components through bi-directional conductors 25 and 26, one conductor 25 being the system data bus and the other conductor 26 being the address bus. A monitor 5 via a monitor interface 4, an alphanumeric keyboard 7 via another interface 6 and claviature (i.e. piano type) keyboard 9 via a third interface 8 are connected to both of these conductors. Keyboard 9 comprises the black and white keys of a piano or similar instrument.

Both conductors 25 and 26 are also connected to the inputs of a counter 11, which receives pulses from a clock 12. The output of counter 11 is connected to a waveform memory 14 through address bus driver 13. Memory 14 is also a random access memory (RAM). Furthermore, an interpolator 15 and a Fourier transformer 16 are connected to both connectors 25 and 26. The Fourier transformer is a commercially available unit, which performs the Fourier transformation of its input signals. Units 15 and 16 are also connected through their outputs to waveform memory 14 via bi-directional conductors 27 and 28, conductor 27 constituting the waveform memory data bus and conductor 28 the waveform memory address bus. A driver circuit 10 is also connected between conductors 27 and 25. A data latch 17, a digital/analog converter 18, containing a low pass filter at its output, an amplifier 19 and a speaker or headphone 20 are connected in series to conductor 27. Also a serial circuit consisting of a microphone 24, a pre-amplifier 23, an analog/digital convertor 22, with a low pass filter connected to its input, and a driver 21 are connected to conductor 27.

Figure 6:
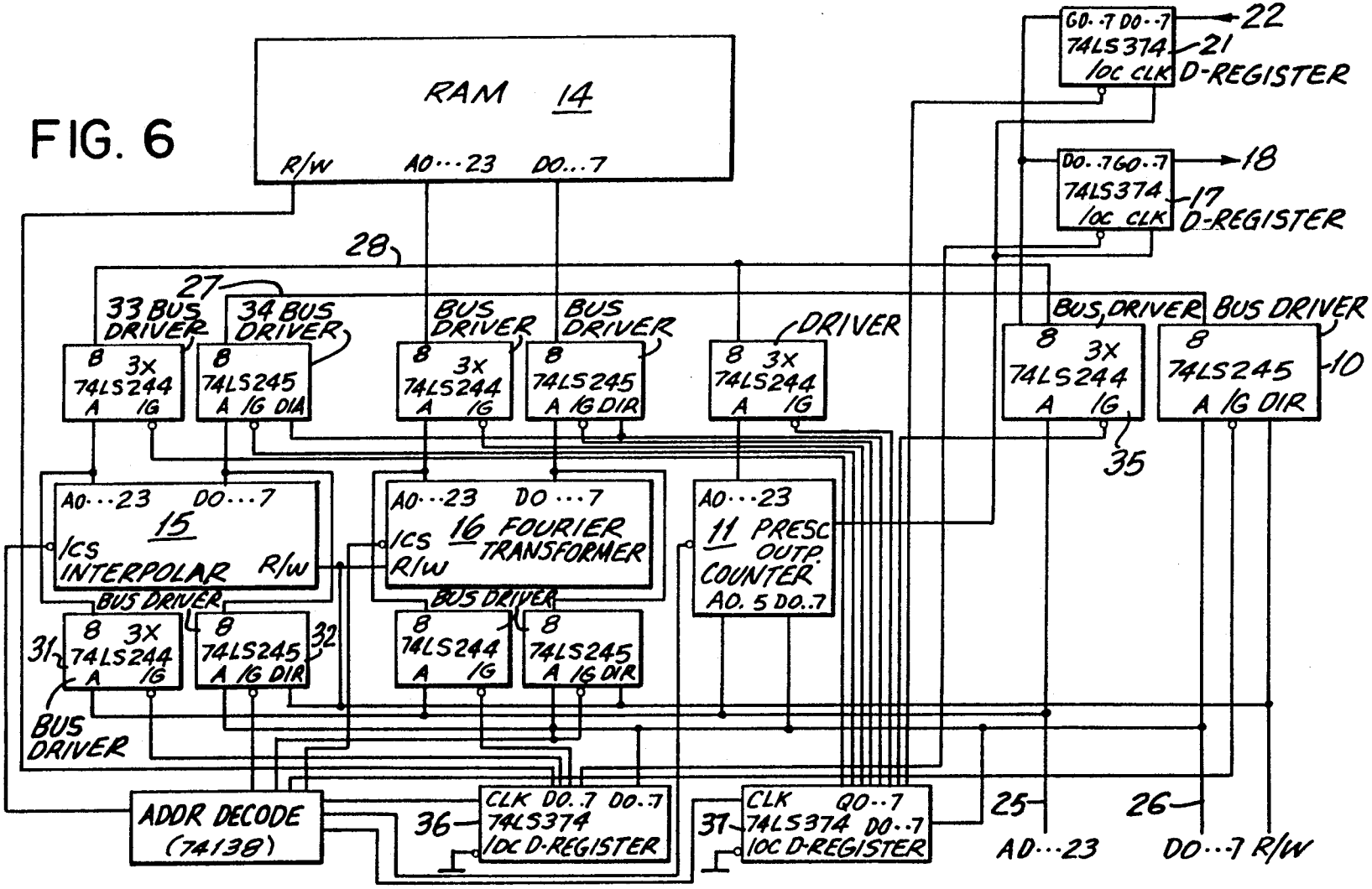
FIG. 6 is a block diagram showing the relationships of the buses and associated units in more detail.

The main buses 25 and 26, as shown in detail in FIG. 6, are connected to various components by so called bus drivers types 74 LS244 and 74 LS245. The drivers are available in commerce from the known manufacturers as National Semiconductor, Texas Instruments, Siemens AG etc. The interpolator 15 is connected with the busses 25 and 26 via the bus drivers 31 addresses) and 32 (bi-directional data). The drivers are controlled by CPU 1 (FIG. 1) via D-registers (74 LS374) (36, 37). The input "G" is responsible for a switching of the driver output to a low-ohmic state; the input "DIR" denotes the direction of the data and is connected with the control line "Read/Write" (R/W) of the CPU.

The control is performed in connection with the D-registers. The CPU (1 in FIG. 1) transmits a 8-Bit-data word to the "D-register. According to the state (set or reset) of the bits (DO . . . 7 which controls the flipflops QO . . . 7) the respective control signals are activated.

The address decode (74138) initiates an access to the subsystem 15. Control line R/W defines the direction for transmittal of the data. Because the data drive is allowed to be activated only within a very short time period of a CPU-bus cycle, its "G"-line is controlled by the address decoder.

The data lines and the address lines of interpolator 15 are also connected with a local RAM-bus (27, 28) via second drivers (33 and 34). The control is also performed by D-registers (74 LS374). The same is valid for the Fourier transformer 16.

The programmable counter 11 has only address outputs (AO . . . 23). It is programmed via Do . . . 7 by the CPU (1) for addressing of the internal registers via A0 . . . 5. The frequency divider output "Prescaler Output" performs during the playback a synchronous output of the waveform data from RAM 14 to the D-register 17. When recording (by 22 . . . 24) the data are loaded in synchronism with the recording into the D-register 21. In both cases (recording and playback) the control input is the input "CLK". The output "OC"=Low activates the register outputs. The CPU 1 (FIG. 1) has a direct access to RAM 14 via the drivers 35 and 10.

Figure 3:
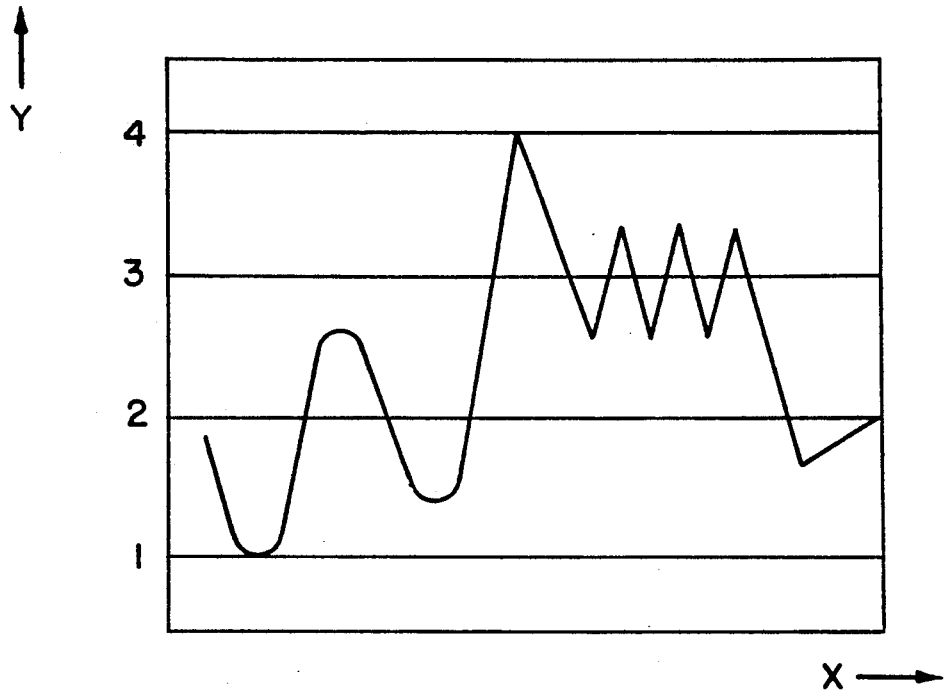
FIG. 3. is a diagram of waveform used in explaining the principles and function of the embodiments of the invention described herein.
Figure 4:
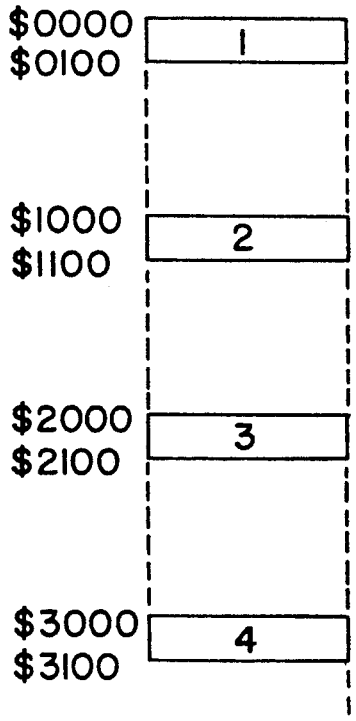
FIG. 4 is a diagram illustrating the memory arrangement of a memory field of the waveform or sound data memory used in the invention.

Referring now to FIG. 1, the recording and storage of tones or waveforms will now be described. With the help of keyboard 7, which may also include a joystick, a mouse or a light pen, the user produces any waveform on the monitor as an input step. These waveforms are "basic waveforms." An example of such a waveform is shown in FIG. 3. The Y axis in this first input step is the amplitude of the tone, while the X axis may be the time or the frequency. Also the variation in time of a signal or its spectral variation may be provided. After another analog/digital conversion that may have to be carried out, when the input is variation in time, this first waveform is stored in waveform memory 14 in the first memory field starting with address $000, as shown in FIG. 4. Further basic sound data are produced similarly and stored in further memory fields—in FIG. 4 designated as memory fields $1000, $2000, $3000, etc.

If the basic waveforms are input in the spectral region (in this case axis X of FIG. 3 represents the frequency), the data is not stored directly, but via a Fourier transform unit 16, which first transforms the data given in the spectral region into data in the time region. Unit 16 is an independent computer subsystem performing Fourier transformations, as for example marketed by the German firm MEDAV, D-8520 Buckenhof, as type number MOS FFT. All individually entered basic sound data have a constant word length in waveform memory 14, for example, 256 eight-bit words per waveform.

At this point free spaces will remain between the individual basic sound data, for example in FIG. 4 between addresses $0100 and $1000, etc. These spaces are then filled, under the control of CPU 1, with the interpolated or extrapolated values of sound data from at least two adjacent basic sound data. Interpolator 15, calculating interpolation values between adjacent basic sound values, is used for this purpose. Linear interpolation can be used; however, other types of interpolation can also be utilized, such as an e-function interpolation, which better corresponds to the naturally occurring sound changes. The interpolator is an independent computer subsystem including a microprocessor having a CPU, ROM and RAM as disclosed in U.S. Pat. No. 4,348,929.

As a result of this interpolation or extrapolation, smooth and dynamic transition is obtained from a basic waveform entered to the next basic waveform entered, making a "dynamic" changeover from one tone to another tone possible.

Instead of waveform input via keyboard 7 and monitor 5, it is also possible to record sounds via microphone 24, which are then digitized via analog/digital converter 22 (so-called "sampling") and then stored in a similar way in waveform memory 14. According to the sampling theory, at least two sampling values are required per period of the highest frequency present. However, according to the quality of the low pass filter used in reproduction, more sampling values may be taken. Then interpolation can be performed also between two such adjacent tones or basic sound data.

In another input step, another "curve," representing the sound parameter "time," is produced via keyboard 7 and monitor 5, which determines the sequence in which the individual memory fields are read. Also in this case, any curve shape can usually be entered. One of the axes (for example, the Y axis) designates the memory address of the sound data to be read, while the other axis (X axis) determines the moment in which the designated sound data should be read. If, for example, a rising straight line is entered, the sequentially stored sound data are read sequentially by increasing address numbers. Thus in a read cycle a continuous, i.e., dynamically changing sound spectrum is obtained between at least two basic sound data entered. Of course, a read cycle may extend over more than two basic sound data and the interpolation values between them or the extrapolation data located outside two adjacent basic sound data. On the other hand, if, for example, a horizontal line is entered, only a single sound data (for example, with 256 words or "sampling values") will be read, however, several times successively. If a triangular curve is entered, successive sound data first with increasing address numbers, then with decreasing address numbers will be output. However, if the curve is too steep, then according to the slope of the curve—some addresses will be passed over during the read cycle. Of course, non-linear functions can also be entered as curves for reading.

In another input step, which chronologically is usually the first input step, at least one further sound parameter is defined. Parameters can—as mentioned above—be the force of keystroke on the keyboard or claviature, the pitch of a tone or another position of an adjusting device. The selection of this parameter is based on the fact that in many natural musical instruments, a changed sound intensity changes not only the amplitude of the tone produced, but also its character. The same applies also to the pitch, whose change alters not only the frequency of the tones produced, but also their character in many instruments. This is explained among others, by the fact that the bodies of many instruments have a certain natural resonance or they also produce certain non-harmonic vibrations in response to different pitches and/or sound intensities.

These sound parameters can also be input via keyboard 7 with the help of monitor 5; again, non-linear functions, such as a quadratic function, an e-function, etc., can also be input. The Y axis can represent the "parameter function," while the X axis then represents the parameter itself. As becomes clearer from the description that follows, the "parameter function" determines the address of the sound data to be read. In the second embodiment it also determines those sound data between which interpolations should take place and the interpolation step width.

Figure 5:
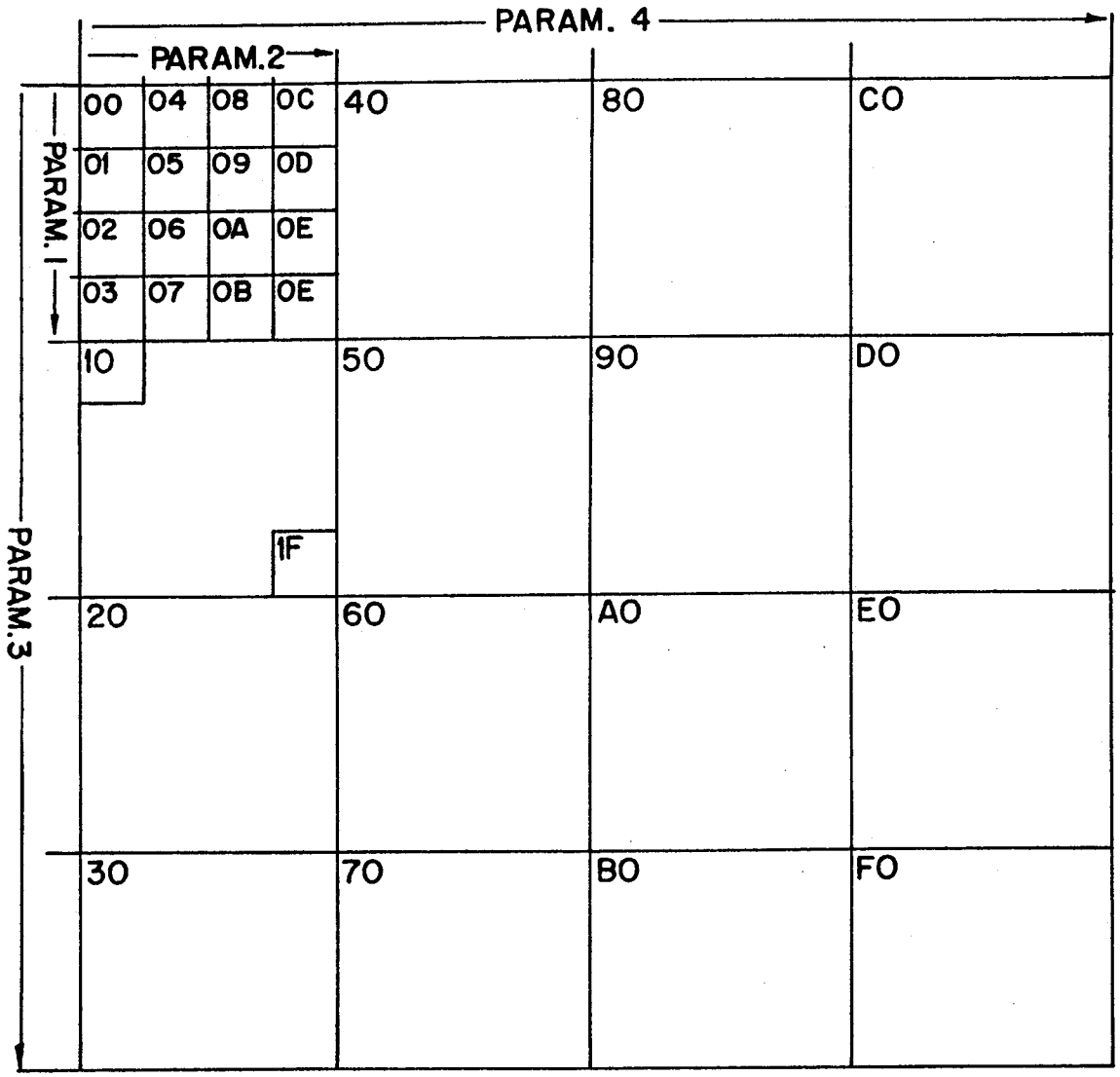
FIG. 5 is a schematic explaining the memory arrangement of the entire waveform or sound data memory used in the invention.

Said waveform memory 14 is—as shown in FIG. 5—organized as follows. Each of the individual fields shown in the upper left part of FIG. 5 (here with addresses 00 through OF) contains a basic waveform as a basic sound data, for example of 256 word, according to FIG. 3. Then, each column corresponding to these words, with field numbers 00, 01, 02, 03, and 04, 05, 06, 07, and 08, 09, OA, OB, and 010, OD, OE, OF, respectively, contains a "waveform set," according to the storage arrangement explained with reference to FIG. 4. A "waveform set" designates a multiplicity of interrelated waveforms, which are read in full during a normal read cycle. As explained above, there are also read forms for which not all sound data of a waveform set are read. In this case, parameter 1 further designates the "time" when the individual fields are read. By shifting parameter 2, the respective column is set; thus, for example example the column with fields 04, 05, 06 and 07. With parameter 3 another "block" is accessed, containing the 16 fields 10 through IF; 20 through 2F, etc. This parameter 3 may be, for example, the force of stock on the individual keys of the keyboard. The position of a manual adjustment device can be determined, for example, through Paragraph 4. With this adjustment device different instruments (e.g. violin, piano, flute, etc.) can be selected or special sound effects can be set.

In principle, the memory arrangement illustrated in FIG. 5 represents a four-dimensional data field. In general, also an n-dimensional data field can be created with this memory arrangement, which is particularly desirable when even more sound parameters are to be introduced, e.g., a tremolo, an echo or reverberation, an accentuation of the amplitudes of certain frequency ranges, etc.

To elucidate this point, let us assume that for the embodiment of FIG. 5 the sound is recorded through the microphone, and that the sound of a piano is to be recorded. For the parameter "pitch" several (in the example four) pitch ranges are defined. Then with a first keystroke force a key in the first pitch range is depressed, the sound waves thus created are sampled and digitized and stored under memory address 00. Then the same key is depressed with a different force and the digitized sound is stored under memory address 40. The same procedure is then followed with difference keystroke forces for memory addressed 80 and C0.

Then a key is depressed with the (four) different keystroke forces in the second pitch range; the basic sound data recorded are stored under addresses 04, 44, 84 and C4. Thus the first row of the matrix of FIG. 5 is stored with fields 00, 04, 08, OC, 40 . . . 4C, 80 . . . 8C, CO . . . CC. In another embodiment of the invention, not all sound data in the fields adjacent in relation to the different parameters have to be basic sound data. Furthermore, also in this case intermediate values can be obtained by interpolation. Regarding parameter 2 of FIG. 5, fields 00, 04, 08 and 0C are adjacent. It would thus suffice, for example, to store basic sound data in fields 00 and 0C, while the sound data for the intermediate fields 04 and 08 could be obtained by interpolation. Regarding parameters 3 of FIG. 5, fields 00, 10, 20 and 30 are adjacent and regarding parameter 4, for example, fields 00, 40, 80 and CO are adjacent. Also in this case, interpolation can be done in principal between these adjacent fields. It should be emphasized that in practice memory 14 has, of course, more fields than the 256 fields shown in FIG. 5.

When recording natural sounds, parameters 2, 3, and 4 determine the start address of a series of fields adjacent in relation to remaining parameter 1. As described below, parameter 1 is the "time." Thus it determines the character of a sound that changes dynamically in time, while parameters 2, 3, and 4 remain theoretically unchanged. While recording a complete, dynamically developing sound, fields 00, 01, 02, 03 or 08, 09, 0A, 0B, etc. are filled consecutively with the respective sound data.

After the above steps the four major blocks with start addressed 00, 40, 80 and CD are filed, while parameter 3 or the adjusting device was in its first position. The same procedure can then be repeated with other adjustment device positions, the user being free to choose which function to assign to parameter 3 or to the adjusting device. For example, in the second adjusting device position another instrument can be recorded, while parameters 1, 2 and 4 can be changed accordingly. In the same way, artificial tones can be produced and stored with the help of keyboard 7 and monitor 5.

The waveform memory is then read through the keyboard, which reports (for example, through very fast, cyclic interrogation of the status of the switches assigned to the individual keys), which key has been depressed and with what force. This can be measured, for example, by switch contacts being successively actuated as the key is depressed, the time between the successive actions of the switch contacts being measured, serving as a measurement of the force of keystroke. Parameters No. 2 and No. 4 (according to FIG. 5) are thus defined. The other two parameters can be preselected through switches, levers, etc., connected to keyboard 7 or claviature 9. Then, by defining the parameters, it is uniquely determined which sound data sorted in waveform memory 14 are to be read. These can be a single sound data or several pieces of sound data (waveform set). The pitch or frequency is determined by the readout rate, as well as through the clock frequency with which the data sorted in the memory is read. Each key is assigned its own readout frequency or clock frequency. To set this clock frequency, timer can be used as a frequency divider, which reduces the (constant) clock frequency produced by clock generator 12 according to the key depressed on keyboard 9 and, with this clock frequency controls driver 10 for the readout of the sound data from waveform memory 14. The sound data read from waveform memory 14 go through data latch 17, which serves as a buffer memory, to digital/analog converter 18, whereby they are converted into analog signals and filtered and smoothed through a low pass filter build into digital/analog converter 18. From there the data go through an amplifier 19 to speaker 20.

The above described "curve" controlling the read procedure and, in more abstract terms, determining the parameter "time," is preferably stored in RAM 3. It is also possible to store it in waveform memory 14, in which case, however, additional memory fields, not shown in FIG. 5, must be provided and through additional means it should be either assured that several memory fields can be read simultaneously, or that the memory fields, provided for the parameter "time," ultimately containing addresses for reading the waveforms, can be read and stored in an intermediate memory.

The individual stored sound data and sound parameters are arranged hierarchically for input and output. The sound parameters, such as keystroke force, pitch or adjusting device position have the highest hierarchy level. Through these a parameter is assigned to certain sound data addresses. When the data is entered through the keyboard and monitor, the X axis may represent the parameter and the Y axis the respective sound data addresses.

The second hierarchical level is represented by the "curve" for sound data readout. This "curve" determines, also when the basic tone is entered, under which memory address are the individual basic sound data stored and thus the size of the intervals between two basic sound data and, finally the length of a waveform set or a sound data set. When input is done via monitor, the X axis represents time and the Y axis the address of the individual sound data. Such a curve may have, for example, a length of 256 words, which then corresponds to 256 memory addresses.

The sound data are then stored in the third (lowest) hierarchy level.

Finally, we shall mention the fact that interpolation or extrapolation can be performed not only between the basic sound data. Furthermore it is also possible to interpolate or extrapolate in relation to sound parameters. Specifically, in the case of the sound parameter "force of keystroke" interpolation is done according to an exponential function.

It can be seen that the individual parameters may be completely independent of each other, which makes a tremendous breath of variation of tones possible With the above-described musical instrument the following advantages are achieved:

Complex, differentiated sound production with the use of any parameters;

Assignment of parameters and production of sound are not bound to any fixed algorithm; therefore even complex natural sounds can be produced;

The individual waveforms can be any direct recordings (digitizing of the variation of sound pressure) of natural instruments. Thus the invention creates a bridge between pure sampling instruments and pure spectral synthesis instruments;

The interpolation and extrapolation described make variable data reduction of the stored sound data and of the stored sound parameters possible. Thus, according to the requirements of fidelity of the reproduced sounds, the number of memory locations can be reduced and thus the access rate can be increased for various types of memories. In spite of the tremendous variety offered, the operation of the device is relatively simple.

Figure 2:
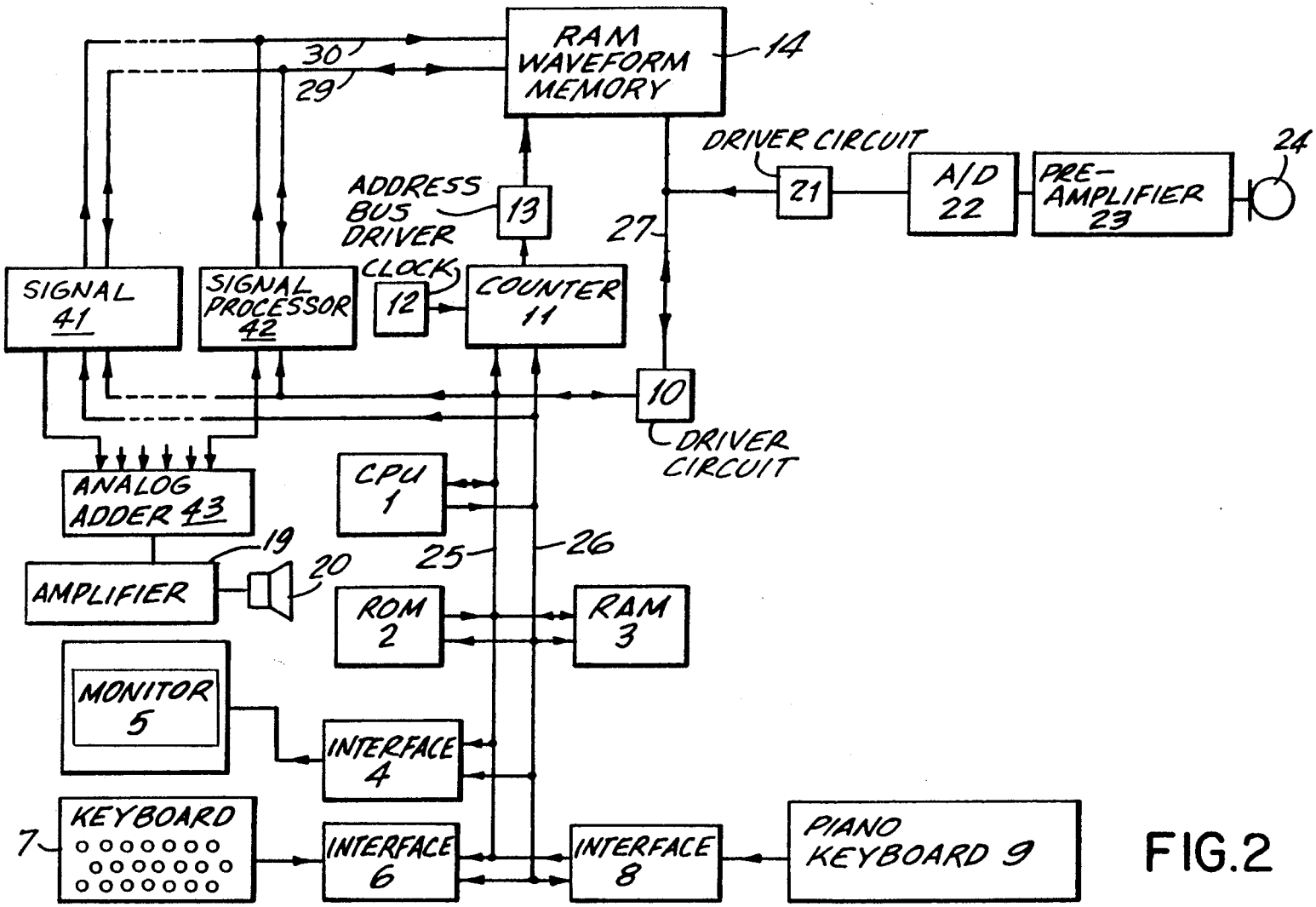
FIG. 2 is a block diagram of a second embodiment of the invention.

The embodiment of FIG. 2 is similar to that of FIG. 3 regarding the block diagram structure. However, the following differences should be noted:

In this case waveform memory 14 is a dual port RAM, which contains both sound parameters and individual sound data. Only the basic sound data are stored for sound data, while interpolation or extrapolation is performed during sound reproduction, and thus almost in real time. Thus RAM 14 of FIG. 2 contains no more interpolated or extrapolated values. Interpolation or extrapolation are performed through signal processors 41 and 42 connected to RAM 14 through conductors 29 and 30 and also connected to conductors 25 and 26. One signal processor 41 processes sound data whose spectral characteristics change with the pitch. The other signal processor 42 processes all those sound data which do not change with the pitch (for example, blowing noises, resonances, etc.). Each signal processor 41 and 42 contains a digital/analog converter, which converts the data processed in the digital form into analog signals. The analog outputs of signal processors 41 and 42 go to an analog adder 43, whose output is connected to a low pass filter. From there the signals go via power amplifier 19 to speaker 20.

As further differences of the embodiment of FIG. 2, it should also be mentioned that in the example of FIG. 2, counter 11 is a programmable forward-reverse counter and drivers 10 and 21 are tristate drivers. The other components of FIG. 2 correspond to those of FIG. 1. Regarding operation, the following differences exist in the embodiment of FIG. 2. There are two matrix structures such as the one shown in FIG. 5 of RAM 14. One contains the waveforms representing the spectral components changeable with the pitch. The other one contains the curve data of the spectral components independent of the pitch.

In the sound production process curve data is read form the first matrix at the rate corresponding to the pitch. At the same time, curve data from the second matrix is read at a rate independent from the pitch, or at least different from that of matrix 1, and the two signals are added. On reason why RAM 14 is a dual port RAM is that reading from both memory fields is done simultaneously. The main reason for the selection of the dual port RAM is, however, that CPU 1 with memories 2 and 3 has access to one port and signal processors 41 and 42 have access to the other port. Parameter values and status information of keyboard 7 and claviature 9 can be input and output through one port, while sound data also run through this port during sound input (for example recording). The sound data run through the other port to signal processors 31 and 32 during reproduction.

These two signal portions are entered separately. In the case of "synthetic" spectra, produced with keyboard 7 with the help of monitor 5, two input sets are produced: one waveform set for pitch dependent spectra and one for pitch-independent spectra.

When recording through microphone 24 (sampling), the sound waves produced by the instrument are sampled and digitized; at least two recordings must be made: one in the lower and another one in the higher instrument tone range. The two wave sets are subjected to a Fourier transformation via the signal processors and their numerical values are calculated. Then the two spectrum values are compared. For this purpose, the minimum spectral distance may be obtained, i.e., the smallest distance to be observed between two spectral lines, according to the resolution capability. Then the two spectral values of the spectra are substracted from each other. The difference independent from the tone is assigned to the first memory field; the rest to the second memory field. After a Fourier back-transformation of the spectral components assumed to be in phase, we have two waveform sets.

For special effects, parts 1 and 2 of the memory can also be subdivided as follows; Part 1 contains all harmonic spectral components (in an integer frequency relationship to the base tone);

Part 2 contains all non-harmonic spectral components, such as blow, draw and other noises, spectral components caused by string torsion vibrations, etc.

The following applies to both possibilities.

Since during reproduction the head rate of part 1 is not proportional to that of part 2 and furthermore, the read rate of part 2 may vary, the sound spectrum of the instrument may be distorted. The read rate of part 2 can be entered graphically, as in the first example of embodiment. Then the pitch may be represented by the X axis and read rate may be represented by the Y axis.

With this second example of embodiment a higher data reduction is obtained, since no more interpolation values have to be sorted in the memory. Namely, only a part of the sound data (i.e., the basic sound data) will be kept in memory 14, while the additional sound data needed for producing the sound are obtained by interpolation during reproduction.

Furthermore, with the second example of embodiment additional effects can be obtained by selecting independently the read rate from part 1 and part 2 of RAM 14. The timbre of the individual tones and the overall sound spectrum can be changed according to the pitch. Even so, due to the graphic input, the effect possibilities remain manageable.

SUMMARY

The electronic musical instrument contains a memory (14), containing sampling values of waveforms in a multiplicity of individually addressable memory fields. An interpolator (15) can produce, in real time, intermediate values between adjacent basic sound data during reading or writing. The individual sound data are read according to sound parameters. The read sequence of the individual sound parameters is determined according to these parameters (FIG. 1).

While the fundamental novel features of the invention have been shown and described and pointed out, it will be understood that various substitutions and changes in the form of the details of the embodiments may be made by those skilled in the art without departing from the concepts of the invention as limited only by the scope of the claims which follow.

What is claimed is:

1. A musical instrument comprising:

a memory unit (14) containing sampled values of least one of waveforms and spectral variations which are stored in a plurality of individually addressable memory locations;

a first bi-directional waveform memory address bus (28) connected to said unit;

a second bi-directional waveform memory data bus (27) connected to said unit;

a third bi-directional address bus (26);

a fourth bi-directional system data bus (25);

a counter (11) connected at an input thereof to the third bus (26) and the fourth bus (25) and connected at an output thereof to said first bus;

first means (17) connected to said second bus (27) to read out waveform data therefrom;

second means (7, 9) connected to said third bus (26) and said fourth bus (25) to supply sampled values of at least one of waveforms and spectral variations thereto; and third means including a central processing unit (1), a random access memory (3) and a read only memory (2), said third means being connected to said third bus (26) and said fourth bus (25), said third means and said counter determining, according to the stored sample values, the sequence in which the individually addressable memory locations and a sound information stored in the locations should be read.

2. The instrument of claim 1 further including fourth means connected to the first means to convert the read out waveform data into sound.

3. The instrument of claim 2 further including an interpolator connected at an input thereof to said second bus (27) and said third bus (26) and connected at an output thereof to said first bus (28) and said second bus (27).

4. The instrument of claim 3 wherein said first means (17) is connected to the second bus (27) at a point intermediate connections of the second bus to the input and the output of the interpolator.

5. The instrument of claim 4, further including fifth means including a microphone (24) and an analog-digital converter (22), connected to said second bus (27) at a point intermediate connections of said second bus (27) to said first means (17) and to the output of the interpolator, respectively, said fifth means converting sound into waveform data.

6. The instrument of claim 5 wherein addresses stored in said unit are assigned to parameters in accordance with a function selected from the group consisting of linear and non-linear functions.

7. The instrument of claim 6 wherein said stored addresses form an n-dimensional matrix wherein each of the dimensions is assigned to a single sound parameter in accordance with said functions.

8. The instrument of claim 5 wherein said second means includes a keyboard and a monitor.

9. The instrument of claim 5 wherein the individually addressable memory locations of the memory unit contain sound data which are interpolated sound data obtained from at least two basic sound data via said interpolator, and wherein addresses of the interpolated sound data are located between addresses of the basic sound data used for interpolation.

10. The instrument of claim 5 wherein the unit contains only the basic sound data and the interpolator controlled by the third means and the counter, provides the interpolation value between two adjacent basic sound values in real time.

11. The instrument of claim 5 wherein memory unit has a first memory field containing the sound data independent from frequency of the tones to be reproduced and a second memory field containing the sound data dependent upon the frequency of the tones to be reproduced.

12. The instrument of claim 11 wherein the unit is a dual port random access memory.

13. The instrument of claim 5 wherein sound parameters are pre-set and the basic sound data is written into the unit by the fifth means under the control of the third means and the counter.

* * * * *